US007744161B2

(12) United States Patent
Berg et al.

(10) Patent No.: US 7,744,161 B2
(45) Date of Patent: Jun. 29, 2010

(54) SYSTEM AND METHOD FOR MODULAR FURNITURE ASSEMBLY

(76) Inventors: Robin Berg, 11620 E. 500 North, Grovertown, IN (US) 46531; Thomas Berg, 11620 E. 500 North, Grovertown, IN (US) 46531

( * ) Notice: Subject to any disclaimer, the term of this patent is extended or adjusted under 35 U.S.C. 154(b) by 278 days.

(21) Appl. No.: 11/925,377

(22) Filed: Oct. 26, 2007

(65) Prior Publication Data

US 2008/0191538 A1 Aug. 14, 2008

Related U.S. Application Data

(60) Provisional application No. 60/889,124, filed on Feb. 9, 2007.

(51) Int. Cl.
*A47C 7/00* (2006.01)

(52) U.S. Cl. ..... 297/440.13; 297/440.14; 297/440.16

(58) Field of Classification Search ..... 297/440.1, 297/440.13, 440.14, 440.16
See application file for complete search history.

(56) References Cited

U.S. PATENT DOCUMENTS 343,588 A * 6/1886 Lewis ..... 217/15
1,822,448 A * 9/1931 Morin ..... 312/258
2,919,045 A * 12/1959 Waugh et al. ..... 220/4.34
3,578,385 A * 5/1971 Stiglitz ..... 297/440.23
3,885,845 A * 5/1975 Krieks ..... 312/265
4,169,639 A * 10/1979 Zola ..... 312/265
5,069,144 A * 12/1991 Williford ..... 108/129
6,692,079 B2 2/2004 Guillot
6,715,837 B2 4/2004 Niederman et al.
6,942,298 B2 9/2005 Harrison
6,981,747 B2 1/2006 Wieland et al.

* cited by examiner

*Primary Examiner*—Joseph F Edell
(74) *Attorney, Agent, or Firm*—Advantia Law Group; Michael W. Starkweather

(57) ABSTRACT

A modular furniture assembly for securing together a plurality of furniture members, the modular furniture assembly comprising: a plurality of substantially planar frame members, each frame member comprising a plurality of ends, the plurality of ends comprising: a first end including a first cavity extending latitudinally along the first end; and a second end including a second cavity substantially identical to the first cavity, the second cavity being oriented and extending latitudinally along the second end such that a combined cavity is formed when the first end and second end come together; a base furniture member; and a securing system, configured to secure a first substantially planar frame member to a second substantially planar frame member, the securing system comprising an elongated member sized to extend through the combined cavity. The plurality of furniture members may comprise: a front member; opposing side furniture members; and a back furniture member.

1 Claim, 9 Drawing Sheets

SYSTEM AND METHOD FOR MODULAR FURNITURE ASSEMBLY

CROSS-REFERENCE TO RELATED APPLICATIONS

This invention claims priority, under 35 U.S.C. §119(e), to the U.S. Provisional Patent Application No. 60/889,124 filed on Feb. 9, 2007, which is incorporated by reference herein.

BACKGROUND OF THE INVENTION

1. Field of the Invention

The present invention relates to furniture assembly and construction, specifically to systems and method for modular furniture assembly.

2. Description of the Related Art

In the related art there exists a wide variety of types and kinds of furniture and methods for assembling furniture. Typically furniture, such as sofas, chairs, etc., is manufactured and assembled in a factory and shipped as complete units to be distributed and sold at retail and warehouse outlets. However, complete furniture units, such as sofas, desks, etc. are bulky, difficult to move and maneuver, and costly to replace if they become aged or damaged. The alternative to this exists in the form of ready-to-assemble, modular, or otherwise self assembly furniture, wherein a consumer purchases the furniture parts and assembles the furniture themselves.

The ready-to-assembly or modular furniture attempts to solve many of the problems associated with the complete unit furniture as described above. Modular furniture typically is readily assembled and disassembled. The owner moves modular furniture by taking it apart and moving the parts to a new location. This advantage is particularly important in small spaces, such as small room or apartments which have close quarters. However, the commercial success of modular furniture has been somewhat limited.

Some advances and improvements have been made in creating and discovering modular furniture assemblies. Examples of references related to the present invention are described below, and the supported teachings of each reference are incorporated by reference herein:

U.S. Pat. No. 6,981,747, issued to Wieland et al., discloses a fully upholstered, ready-to-assemble article of furniture which may be custom ordered by a consumer, packaged by the seller for shipment to the consumer by a parcel delivery service, and then assembled by the consumer from the packaged components. The article of furniture includes a frame of a plurality of interlocking, planar frame members which are secured together by fasteners received in push-in connector elements. Upholstery coverings, the design of which is custom selected by the consumer, are attached to the frame and secured to one another by hook and loop fasteners. Foam elements are received within a second plurality of upholstery covers which have large openings for receiving the foam elements to provide cushions for the article of furniture. The frame members, upholstery covers, and foam elements are packaged in first, second, and third containers, respectively, which are each light enough to be shipped for home delivery by a parcel delivery service.

U.S. Pat. No. 6,692,079, issued to Guillot, discloses a frame assembly for securing a plurality of modular sofa parts together into a sofa frame. The frame assembly includes a pair of tapered members attached to opposing sides of a backrest sofa part and a pair of receptacles attached to a respective one of a pair of rails, which are in turn attached to a pair of armrests. The backrest is connected to the armrests by inserting each of the tapered members into a tapered slot defined by each respective receptacle and is further strengthened using a pair of overlapping securing members. The tapered shape of the tapered members and slots produces a positive fit that has two directional components to prevent rocking of the backrest in two directions. The rails are configured to also accept a sleeper unit, and a futon unit allowing the sofa frame to be upgraded or adapted as desired by the user.

U.S. Pat. No. 6,942,298, issued to Harrison, discloses a five-part furniture frame, and method of assembly thereof, consisting of a left arm frame, a right arm frame, a seat box frame, an inside back frame and an outside back frame.

U.S. Pat. No. 6,715,837, issued to Niederman et al., discloses an assembled and disassembled modular furniture system. The furniture system includes a base frame having a front member, a first side member, a second side member and a rear member. A plurality of furniture modules including a first arm module, a second arm module and one of a spring nest module and a sleeper module are mounted to the base frame using a plurality of fastener assemblies. Each fastener assembly includes two portions: a stud member and an aligning receptacle bracket. Each of the stud members and said brackets are secured to opposing locations of the base frame and at least one of the modules so that the modules may be positioned upon the frame by engaging the aligning receptacle brackets upon the corresponding stud members.

The inventions heretofore known suffer from a number of disadvantages and problems of which the objectives and features of the present invention attempt to address. Some of these disadvantages and problems include: being complicated and time consuming to manufacture and assemble; requiring multiple and complicated parts, such as screws, bolts, etc, which can easily be lost or damage; requiring an entirely new piece of furniture upon being damaged or abused; being unstable and non durable; being uncomfortable or unsightly; and/or so forth.

What is needed is a modular furniture assembly and method that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available modular furniture assemblies and methods. Accordingly, the present invention has been developed with the objective of providing a modular furniture assembly and method which is easy and relatively quick and simple to assemble and/or disassemble. Additionally, it is the objective of the present invention to provide a sturdier and more durable modular furniture assembly, while still being comfortable and aesthetically pleasing.

In one embodiment, there is a modular furniture assembly for securing together a plurality of furniture members, the modular furniture assembly comprising: a plurality of substantially planar frame members, each frame member comprising a plurality of ends. The plurality of ends may comprise a first end including a first cavity extending latitudinally along the first end; and/or a second end including a second cavity substantially identical to the first cavity. The second cavity may be oriented and/or extend latitudinally along the second end such that a combined cavity is formed when the first end and second end come together. The furniture assembly may further comprise a base furniture member.

In another embodiment, the modular furniture assembly comprises a securing system, configured to secure a first substantially planar frame member to a second substantially planar frame member. The securing system may comprise elongated member sized to extend through the combined cavity.

In yet another embodiment, the plurality of furniture members may comprise: a front furniture member; a pair of opposing side furniture members removably coupled to the front furniture member; and/or a back furniture member removably coupled to the pair of opposing side furniture members.

In still another embodiment, there may be a method for securing furniture members. The method may comprise: providing a first furniture member, the first furniture member including a first end, the first end including a first cavity extending latitudinally along the first end; and/or providing a second furniture member, the second furniture member including a second end, the second end comprising a second cavity substantially identical to the first cavity extending latitudinally along the second end. The method may further comprise removably coupling the first furniture member to the second furniture member, wherein the removably coupling comprises: aligning the first cavity and the second cavity to form a combined cavity; and/or extending an elongated member extend through the combined cavity.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1:
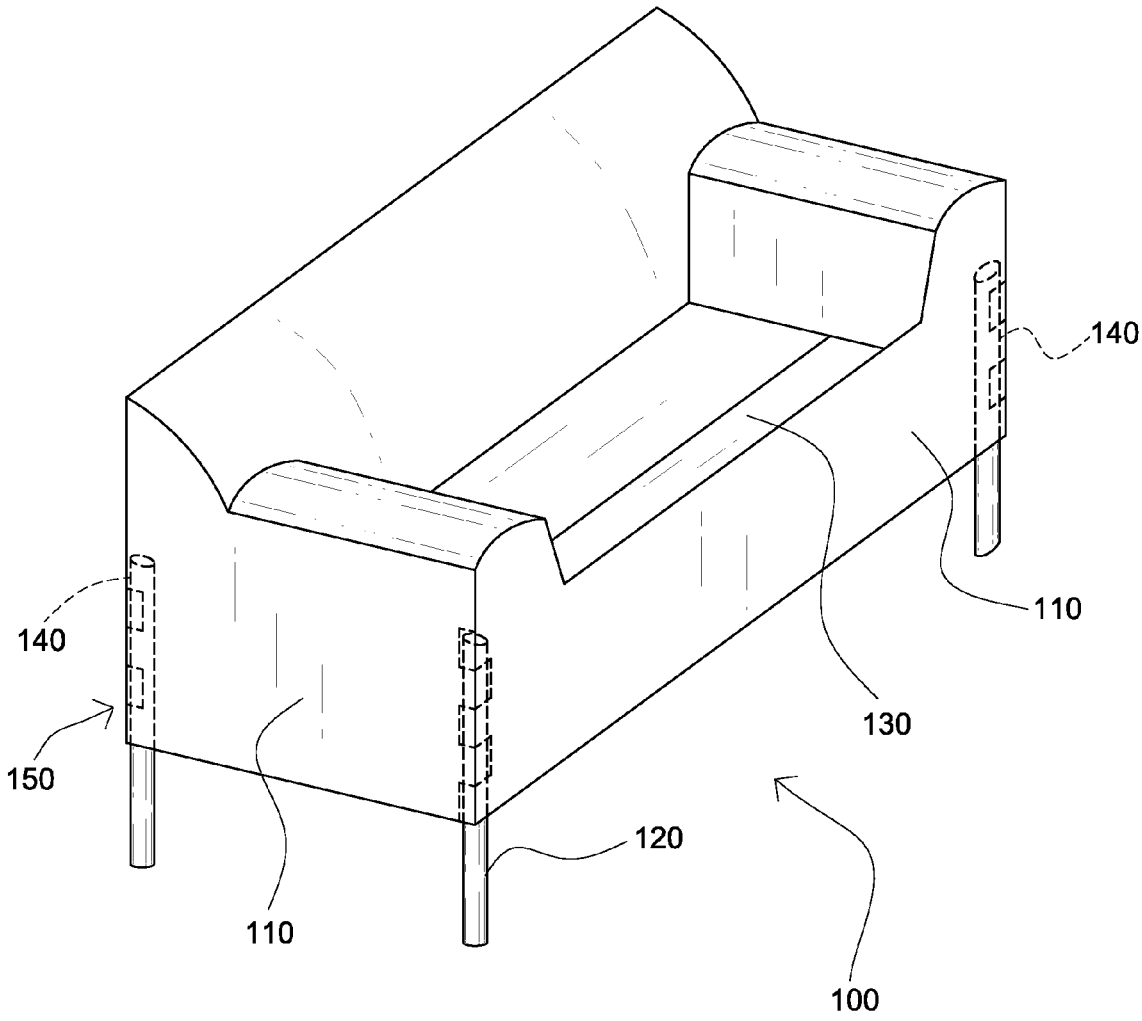
FIG. 1 is a perspective drawing of a modular furniture assembly according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 illustrates a modular furniture assembly 100 for securing together a plurality of furniture members, according to one embodiment of the invention. As shown the modular furniture assembly 100 comprises a plurality of substantially planar frame members 110. In being substantially planar, the plurality of frame members 110 may or may not be completely planar. In a non-limiting example, the plurality of frame members 110 comprise completely planar members comprising materials such as, but not limited to, a variety of wood types, plastics, polyurethane, fiberglass, and/or so forth. In another non-limiting example, the plurality of frame members 110 are not planar but rather include moldings, decorative designs, carvings, fabric, and/or so forth attached thereto or extending therefrom.

Also shown in FIG. 1, the modular furniture assembly 100 includes a securing system 150. The securing system 150 functions to secure the plurality of frame members 110 together. As shown, the securing system 150 includes an elongated member 120. As illustrated, the elongated member 120 is configured to and sized to be inserted in between the plurality of frame members 110 through a combined cavity 140. In this manner the plurality of frame members 110 are secured together, as described in more detail below.

FIG. 1 illustrates one of embodiments of the modular furniture assembly. As shown, the plurality of furniture or frame members 110 is assembled to form sofa. It is contemplated the plurality of frame members 110 may be arranged to form any type of furniture contemplated in the art, such as but not limited to chairs, shelves, desks, cabinets, and/or so forth.

Figure 2:
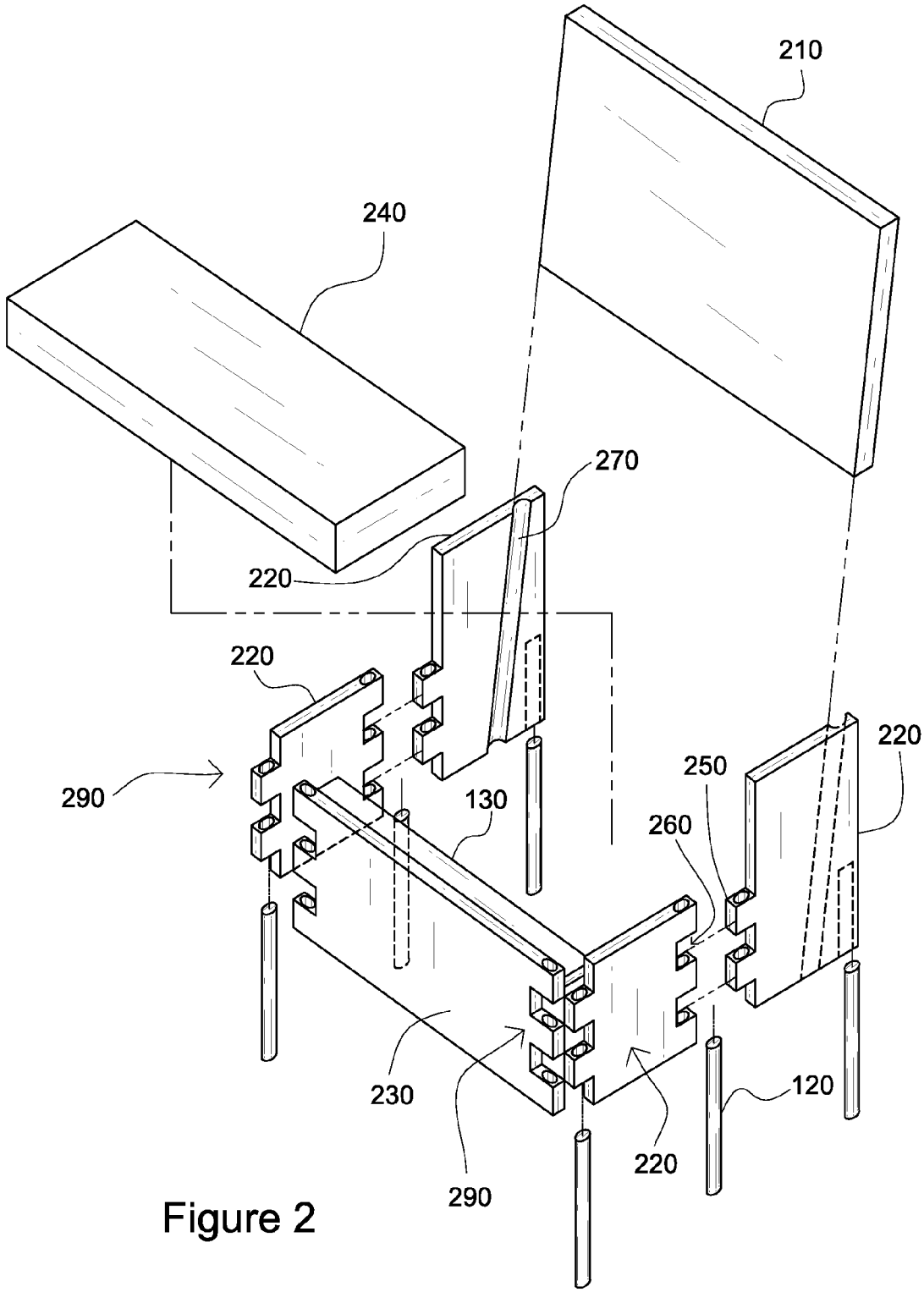
FIG. 2 is an exploded view of a modular furniture assembly, according one embodiment of the invention.

FIG. 2 illustrates an exploded view of the modular furniture assembly 100, according to one embodiment of the invention. As shown the modular furniture assembly 100 includes the plurality of furniture members 110 arranged to form a sofa or couch, each furniture member including one or more ends 290. Also shown, the plurality of substantially planar furniture members 110 include: a front furniture member 230; a pair of opposing side furniture members 220 removably coupled to the front furniture member 230; and a back furniture member 210 removably coupled to the pair of opposing side furniture members 220.

Referring to FIGS. 1 and 2, the front furniture member includes a tab member 130 coupled to the interior side and extending substantially orthogonal therefrom. In one embodiment, the tab member 130 functions to support and secure a base furniture member 240. It is contemplated the tab member 130 may be coupled to and/or extend out from the interior side of the front furniture member 230 in any manner such that the base furniture member 240 may rest securely on the tab member 130. In a non-limiting example, as illustrated, the tab member 130 extends along the length of the interior side, thereby providing support for the base member along the entire length of the front furniture member 230. In an alternative embodiment, the tab member 130 may comprise multiple tab members 130 coupled to and/or extending out from one or more positions on the front furniture member 230. In another embodiment, there may be one or more tab members 130 disposed along the interior sides of any and/or all of the furniture members 110.

FIG. 2 also shows the modular furniture assembly 100 includes a base furniture member 240. In one embodiment, the base furniture member 240 is sized and configured to be inserted in between the front furniture member 230 and the back furniture member 210. Further, the base furniture member 240 is sized and configured to rest and/or be secured on the tab member 130, as described previously. The base furniture member 240 may function as a seating member, configured to have one or more person or objects rest thereon. The base furniture member 240 may be any type and/or kind of base furniture member 240 contemplated in the art, such as but not limited to box springs, mattress portions, one or more cushions, a substantially planar member(s), and/or so forth.

Figure 3:
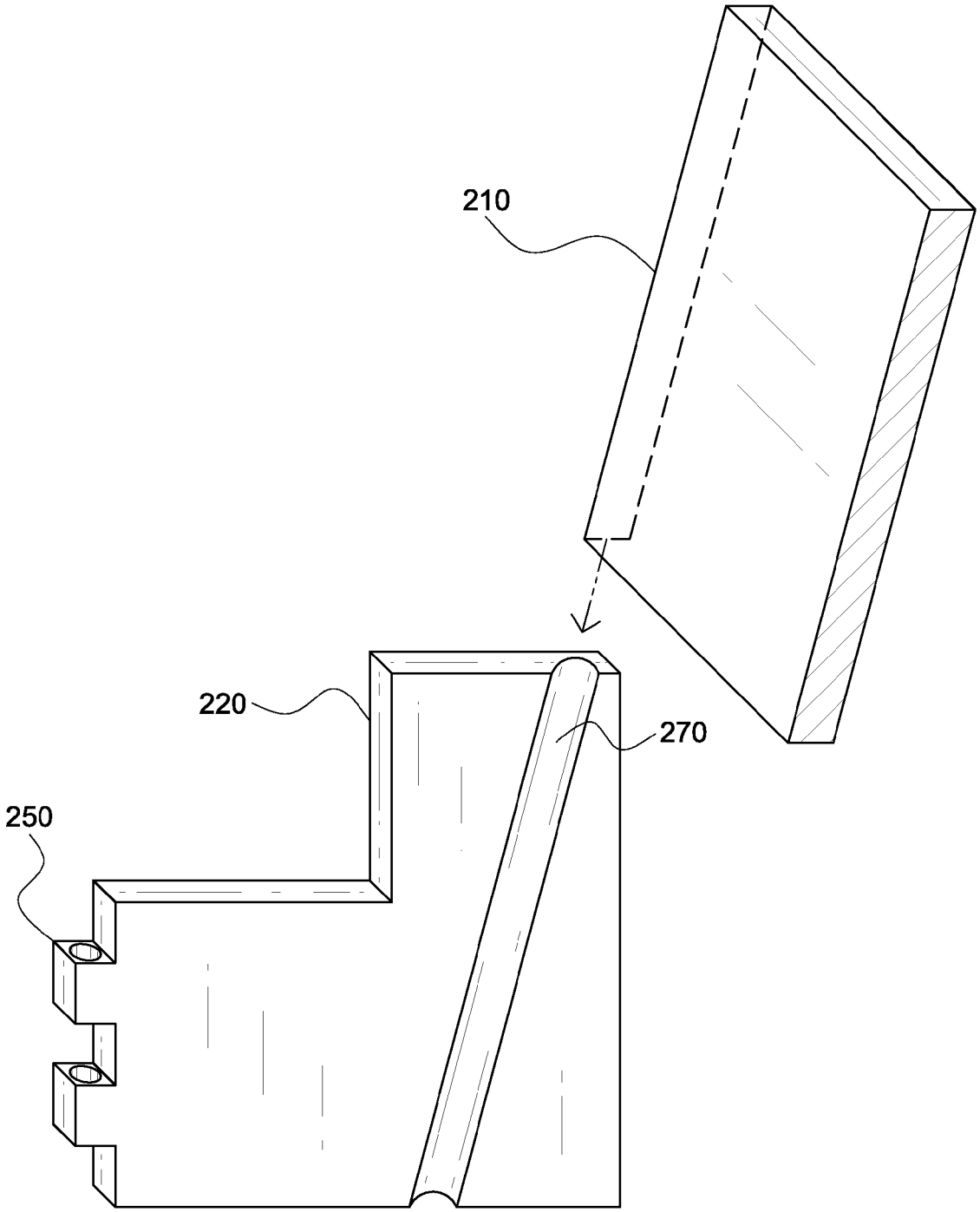
FIG. 3 is a perspective cross-sectional view of a back furniture member removably coupling to a side furniture member of a modular furniture assembly, according one embodiment of the invention.

FIGS. 2 and 3 illustrate one embodiment of the modular furniture assembly. As shown, the pair of side furniture members includes a slot 270 or slotted portion 270. The slot 270 is sized and configured to receive the back furniture member 210. Advantageously, the slots 270, one disposed on each of the side furniture members 220 further enhance the ease of assembly, enabling a user to merely slide the back furniture member into the corresponding slots 270. In an additional embodiment, the slots 270 may include one or more securing mechanisms disposed therein. The securing mechanisms may be any type and or kind of securing mechanism contemplated in the art, such that the back furniture member 210 is removably secured in the slots 270 once the back furniture member is inserted therein.

Figure 4:
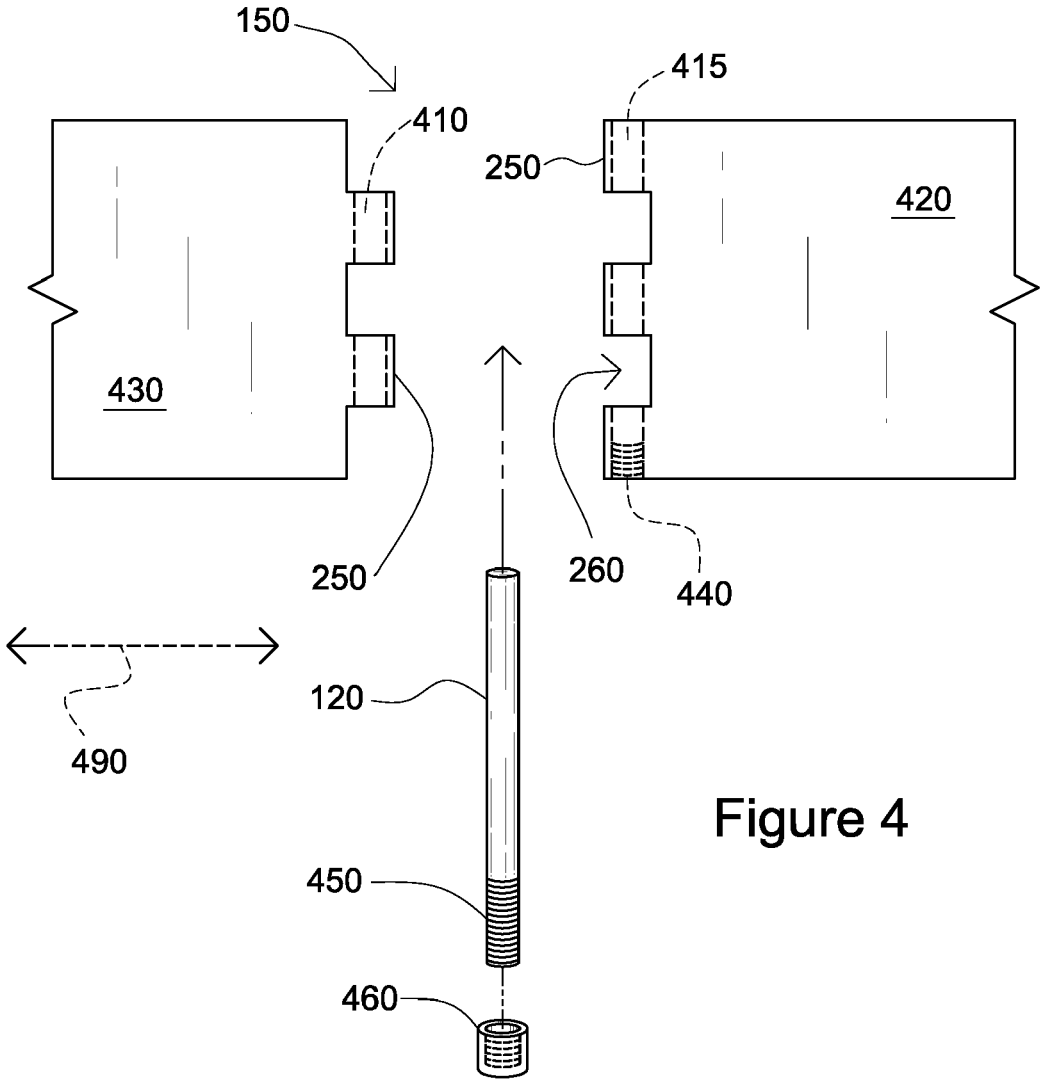
FIG. 4 is a side plan view of a securing system of a modular furniture assembly, according one embodiment of the invention.
Figure 5:
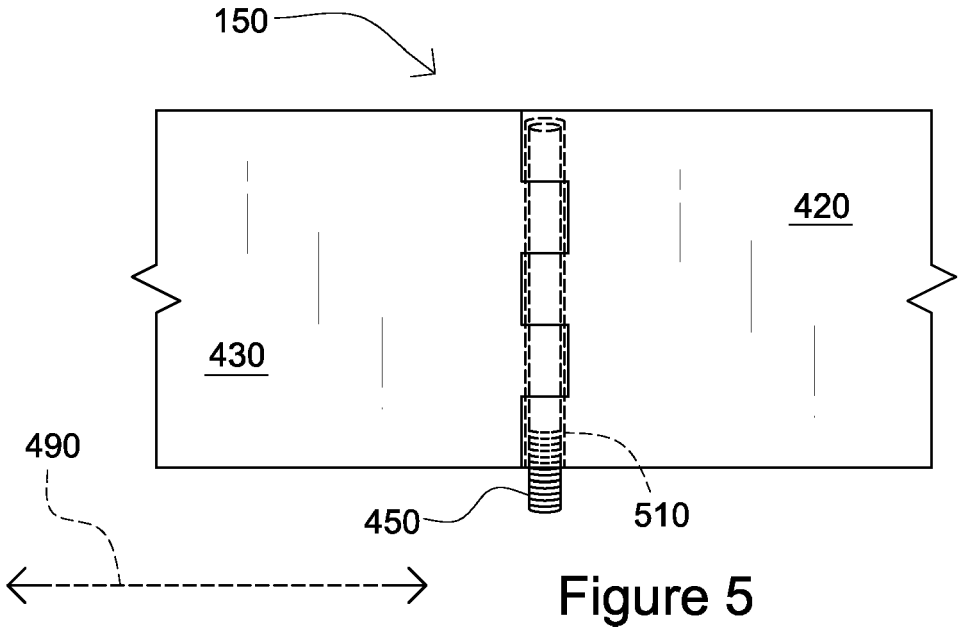
FIG. 5 is a side plan view of a securing system of a modular furniture assembly, according one embodiment of the invention.

FIGS. 2, 4, and 5 illustrate a securing system 150 of a modular furniture assembly, according one embodiment of the invention. As shown, there is a plurality of substantially planar furniture members 110, each furniture member 110 including: a first end 430 including a first cavity 410, the first cavity 410 extending latitudinally along the first end 430; and a second end 420 including a second cavity 415 substantially identical to the first cavity 410, the second cavity 415 being oriented and extending latitudinally along the second end 420 such that a combined cavity 140 is formed when the first end 430 and second end 420 come together. Also shown, the securing system 150 includes an elongated member 120 sized to extend through the combined cavity 140.

In one embodiment, as illustrated in FIGS. 4 and 5, the first cavity 410 and the second cavity 415 extend latitudinally along the first end 430 and the second end 420, respectively. In extending latitudinally, the first cavity 410 and the second cavity 415 extend substantially orthogonal to the axis 490 of the first end 430 and second end 420. In extending substantially orthogonal, the first cavity 410 and the second cavity 415 may be oriented exactly ninety (90) degrees from the axis 490 and/or may be a few degrees more or less, such as but not limited to plus or minus five (5), ten (10), or twenty (20) degrees. The orientation of the first cavity 410 and the second cavity 415 advantageously provide for a more stable and secure coupling of the first end 430 and the second end 420. This in turn provides a more stable and secure coupling for the entire furniture piece.

According to one embodiment of the invention, as illustrated in FIGS. 2 through 4, the first end 430 includes one or more protuberant portions 250 extending from the first end 430; the one or more protuberant portions 250 substantially encasing the first cavity 410. Also shown there is one or more recessed portions 260 extending from the second end 420; the one or more recessed portions 260 sized to receive the one or more protuberant portions 250. The second cavity 415 is substantially encased by the second end 420. In being substantially encased by the protuberant portions 250 and the second end 420, the first and second cavities 410, 415 may or may not be completely disposed internal to the first and second ends 430, 420.

FIGS. 2, 4, and 5 also illustrate the securing system 150 includes an elongated member 120 sized to extend through the combined cavity 140. The elongated member 120 may be any type and/or kind of elongated member or any shape contemplated in the art, such as but not limited to, a rod, a pole, square shaped member, and/or so forth. In a non-limiting example, the elongated member includes a cylindrical rod extendable into the combined cavity. Additionally, the elongated member 120 may comprise any material contemplated in the art, such as but not limited to wood, metal, steel, plastic, aluminum, and/or so forth.

Figure 6:
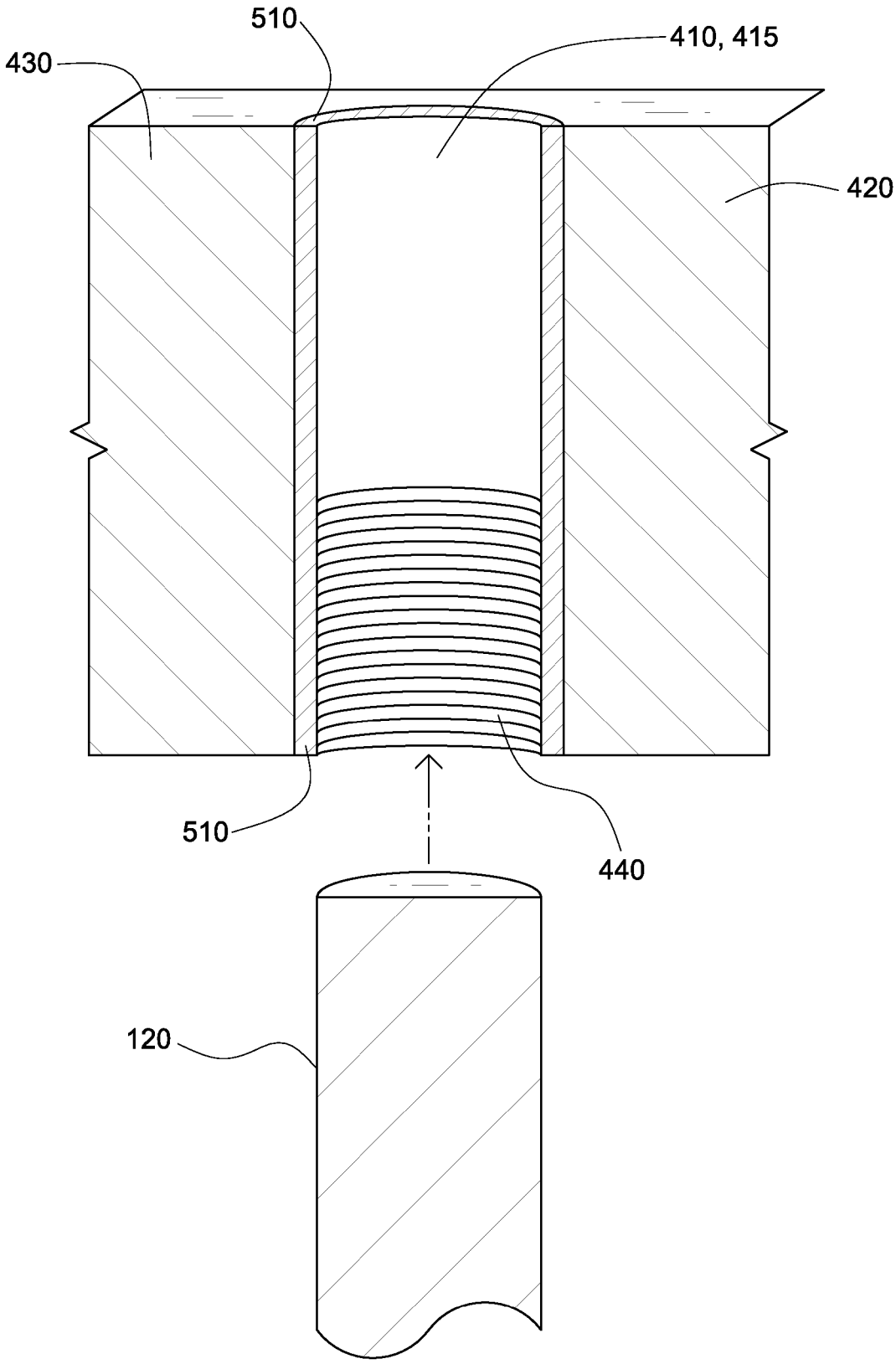
FIG. 6 is a side cross-sectional view of a securing system of a modular furniture assembly, according one embodiment of the invention.

Also illustrated in FIGS. 4 through 6, the securing system 150 includes an elongated member securing mechanism configured to secure the elongated member 120 in the combined cavity 140. The elongated member securing mechanism may include a first securing module 440 coupled to the combined cavity 140 and a second securing module 450 coupled to the elongated member, the second securing module 450 being sized to receive and/or insert into the first securing module 440. Indeed, the elongated member securing mechanism may include any securing mechanism contemplated in the art, such that the elongated member is securely extending through the combined cavity 140.

In one embodiment, as illustrated in FIG. 4, the elongated member securing mechanism includes a threaded portion 450 disposed on the elongated member 120. Further shown, corresponding threads are disposed on the interior of the combined cavity 140. In operation a user extends the elongated member 120 through the combined cavity 140 and then twists the threaded portions, thereby securing the elongated member 120 into the combined cavity 140. In alternative embodiment, the elongated member securing mechanism includes a spring triggered pin internally disposed in the combined cavity 140 and configured to insert into a hole disposed on the elongated member 120.

Also shown in FIG. 4, the modular furniture assembly 100 may include a foot member 460 or shoe member removably coupled to the elongated member 120. The foot member 460 may be any type of foot member contemplated in the art and may be compose of any material contemplated in the art, such as but not limited to rubber, plastic, polyurethane, steel, and/or so forth. Additionally, the foot member 460 may be removably coupled to the elongated member 120 in any manner contemplated in the art, such as but not limited to nut and bolt, screw threads, adhesives, hook and loop, and/or so forth.

Figure 7:
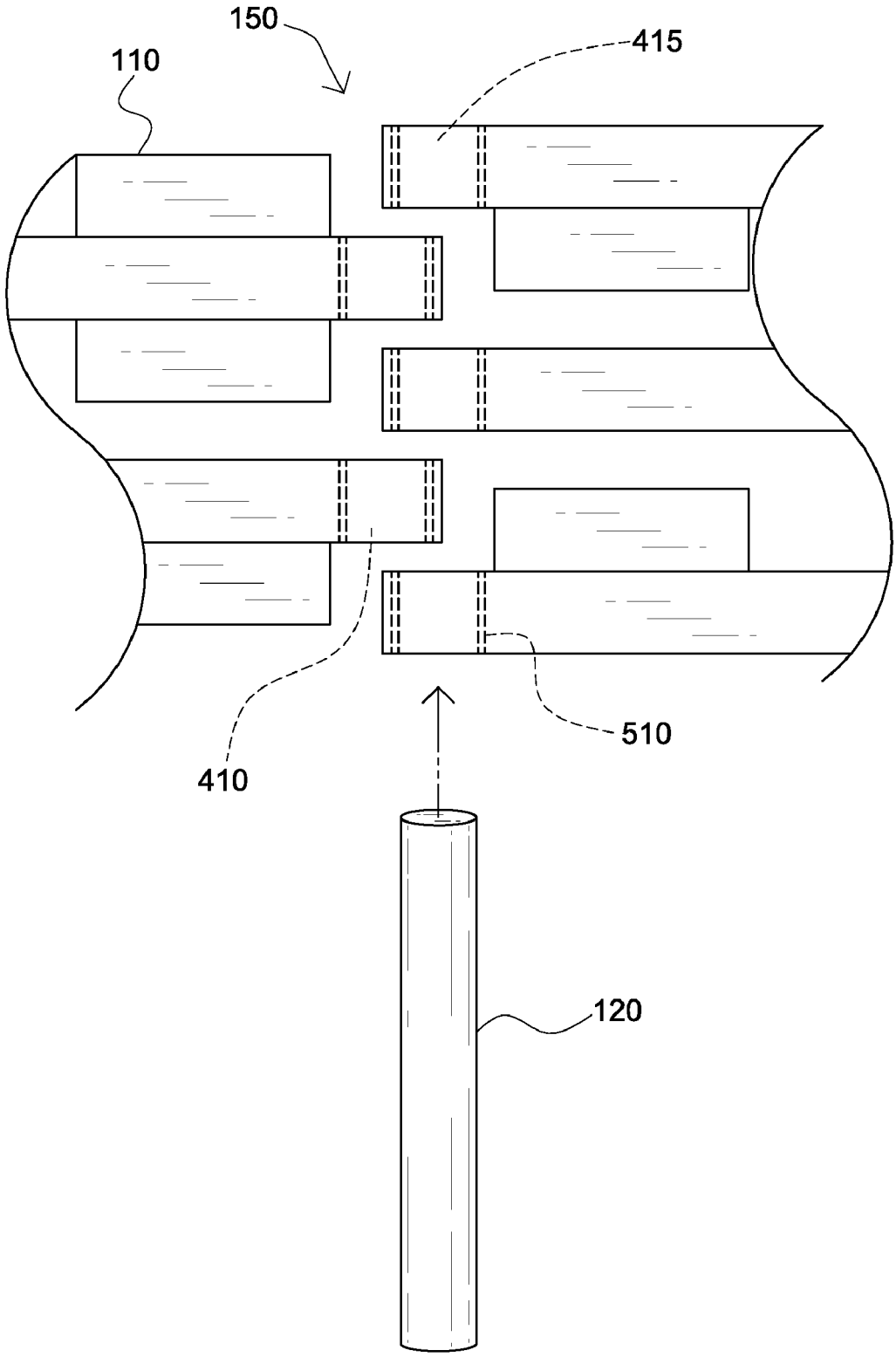
FIG. 7 is a side plan view of a securing system of a modular furniture assembly, according one embodiment of the invention.

FIGS. 5 through 7 illustrate an additional embodiment of the securing system. As shown, the combined cavity 140 includes an elongated hollow member 510 internally disposed therein. The elongated hollow member 510 substantially encases the combined cavity 140 and is sized to receive the elongated member 120. The elongated hollow member may be any size or shape contemplated in the art and may be composed of any materials contemplated in the art, such as but not limited to steel, metal, plastic, polyurethane, aluminum, and/or so forth. In one non-limiting example, as shown, the elongated hollow member 510 is cylindrical and sized to receive a cylindrical elongated member 120.

In another embodiment, illustrated in FIG. 7, the elongated hollow member 510 comprises multiple sections, each section being internally disposed and coupled to the walls of the first cavities 410 and second cavities 415. As shown, the first end 430 and the second end 420 come together aligning both the first cavity 410 and its elongated hollow member 510 to the second cavity 415 and its elongated hollow member 510.

Advantageously, in one embodiment, the elongated hollow member 510 provides durability and sturdiness to the securing system and entire modular furniture assembly 100. This is readily apparent as wood and/or materials typically used in furniture age over periods of time. The wood and other materials expand and/or are otherwise damaged, in many instances leaving uneven or unmatched portions. The elongated hollow member 510 enables the first cavity 410 and the second cavity 415 to maintain the proper the shape thereof. In this manner, for extended periods of time the first and second cavities 410, 415 may align properly and evenly to form the combined cavity 140, thereby enabling proper insertion of the elongated member 120.

Figure 8:
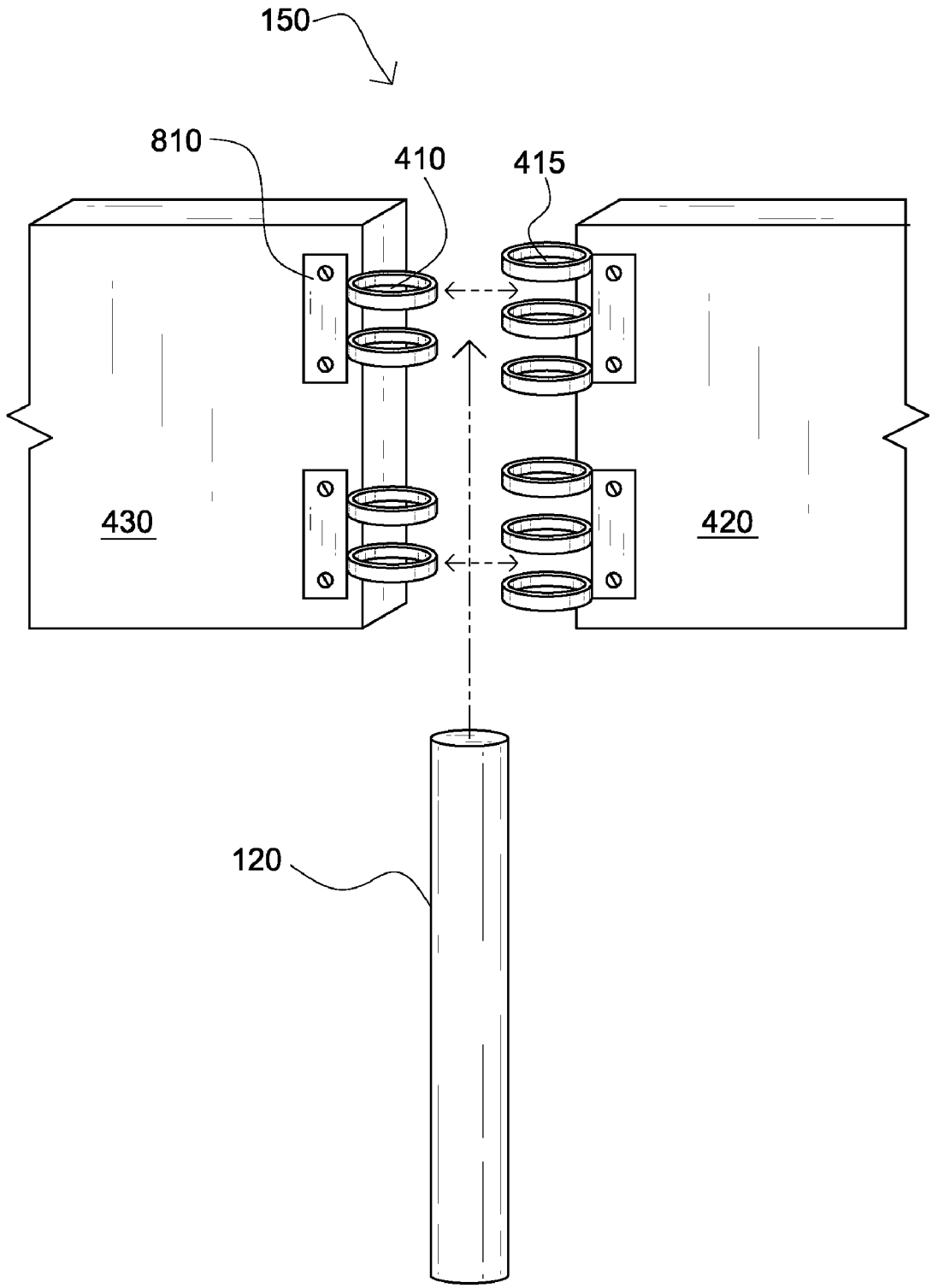
FIG. 8 is a side plan view of a securing system of a modular furniture assembly, according one embodiment of the invention.

FIG. 8 illustrates an alternative embodiment of a securing system 150 of the modular furniture assembly 100. As shown, there is a plurality of substantially planar furniture members 110, each furniture member 110 including: a first end 430 including a first cavity 410, the first cavity 410 extending latitudinally along the first end 430; and a second end 420 including a second cavity 415 substantially identical to the first cavity 410, the second cavity 415 being oriented and extending latitudinally along the second end 420 such that a combined cavity 140 is formed when the first end 430 and second end 420 come together. Also shown, the securing system 150 includes an elongated member 120 sized to extend through the combined cavity 140.

As shown in FIG. 8 the securing system 150 is embodied in one or more hinge portions 810. The first half of the one or more hinges is coupled to a first end 430 and the second half of the one or more hinges is coupled to the second end 420. As illustrated, as the first end 430 and the second end 420 come together, the first cavity 410 and the second cavity 415 align to form a combined cavity 140. An elongated member 120, as described herein, may then be extended through the combined cavity 140, thereby securing the first end 430 of a furniture member 110 to the second end of a furniture member 110. It is contemplated the one or more hinge members may be oriented and/or disposed on the first and second ends 430, 420 in any manner such as to provide durability and sturdiness to the modular furniture assembly 100. In a non-limiting example, the one or more hinge members may include a single elongated hinge extending substantially along the entire length of the first and second ends 430, 420. In another non-limiting example, there may be two or more hinge members extending substantially along the length of the first and second ends 430, 420.

In one embodiment, the hinge 810 may be any type and/or kind of hinge contemplated in the art. Some non-limiting examples of hinges include: strap hinges, final tipped hinges, concealed hinges, overlay hinges of varying degrees, short-side hinges, and/or so forth. Examples of such hinges are readily available from the retail and warehouse hardware outlets such as Hardware Source of San Diego, Calif.

Figure 9:
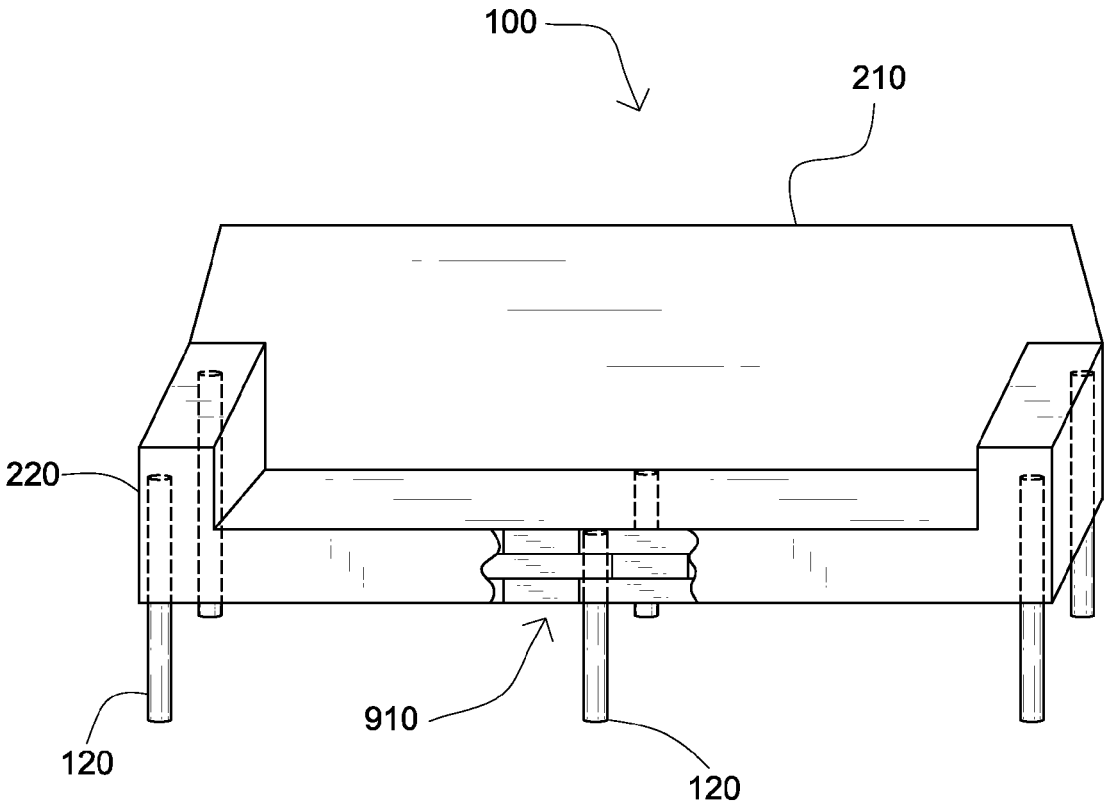
FIG. 9 is a perspective view of a modular furniture assembly, according one embodiment of the invention.

FIGS. 1 and 9 illustrate the ability modular furniture assembly to be arranged and/or configured in a variety of ways. Specifically, FIG. 9 in contrast with FIG. 1 demonstrates the modular furniture assembly's 100 ability to form or include a variety of furniture shapes and/or sizes. As shown in FIG. 1, the arrangement is of a sofa or a couch which mirrors a loveseat or smaller sofa assembly. FIG. 9 shows a modular furniture assembly 100 including additional furniture members 110 and securing system 150 added to the central portion sofa. The additional furniture members 110 and the securing systems 150 function to extend the length of the modular furniture assembly 100. It is contemplated there may be numerous arrangements and/or configurations possible with the modular furniture assembly.

Figure 10:
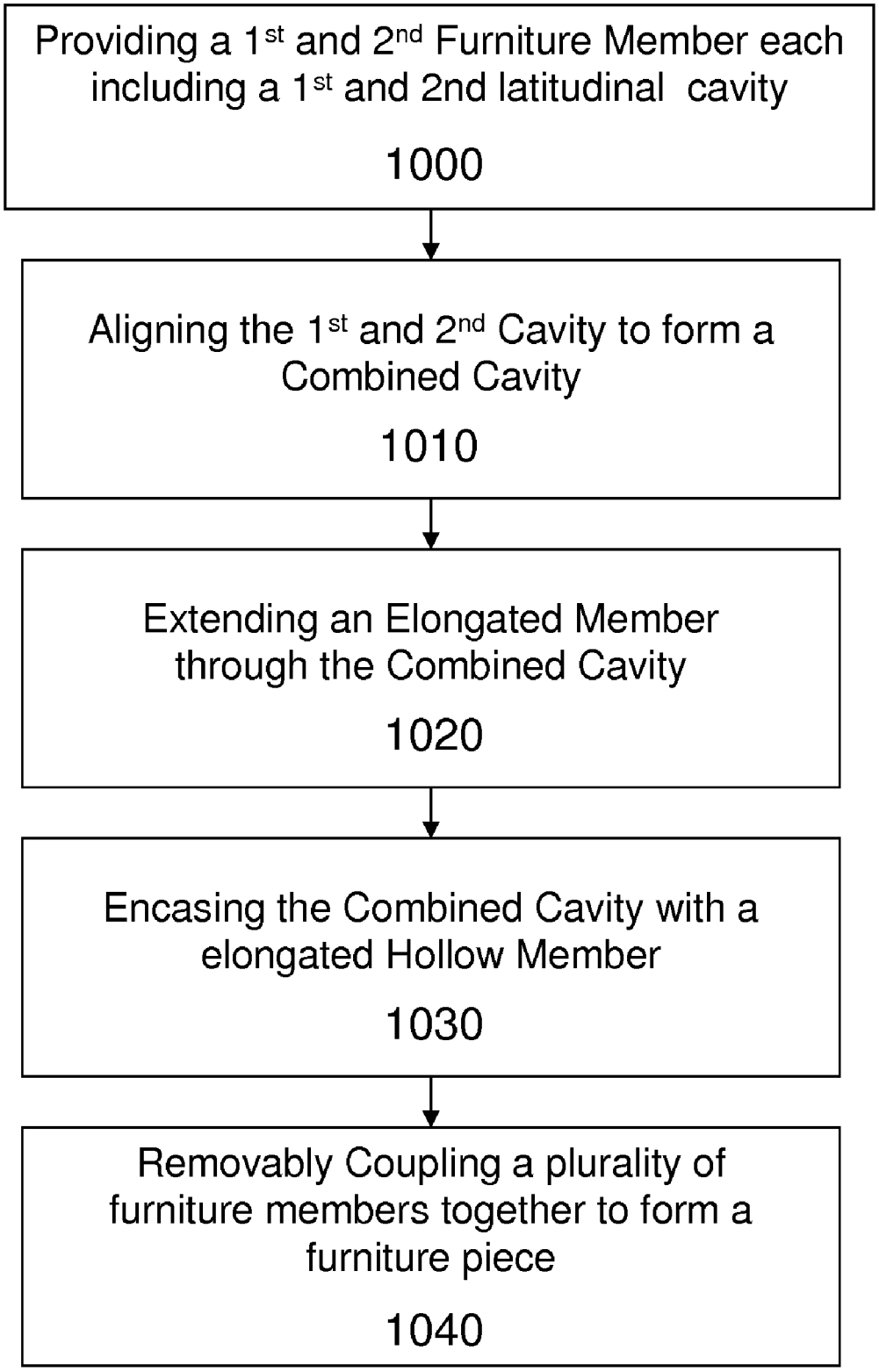
FIG. 10 is a flow chart illustrating a method for modular furniture assembly, according to one embodiment of the invention.

Shown in FIG. 10 there is a method for securing furniture members. The method comprises the steps of: providing 1000 a first furniture member, the first furniture member including a first end, the first end including a first cavity extending latitudinally along the first end; providing 1000 a second furniture member, the second furniture member including a second end, the second end comprising a second cavity substantially identical to the first cavity extending latitudinally along the first end; and removably coupling the first furniture member to the second furniture member. Removably coupling the first furniture member to the second furniture member may includes the steps of aligning 1010 the first cavity and the second cavity to form a combined cavity and extending 1020 an elongated member extend through the combined cavity. The method additionally includes encasing 1030 the combined cavity with an elongated hollow member and removably coupling 1040 a plurality of furniture members together.

In one embodiment, the operation and use of the modular furniture assembly and method provide a relatively simple and quick process of manufacturing, assembling, and constructing furniture. Additionally, the various features as described herein enable the modular furniture assembly to be sturdy and durable. In operation a first furniture member 110 is removably coupled to a second furniture member 110 by assembling together the first end 430 and the second end 420 and aligning the first cavity 410 with the second cavity 415 to form a combined cavity 140. An elongated member 120 is then extended through the combined cavity. Subsequently, a first securing module 440 is coupled to a second securing module 450, which secures the elongated member into the combined cavity 140 and securely couples the first furniture member 110 to the second furniture member 110.

In one embodiment, as described herein and illustrated in FIGS. 4-7, the plurality furniture members 110 include one or more ends 430, 420 that contained protuberant and recessed portions which mirrors interconnecting pieces. These interconnecting pieces may fit together, thereby aligning the first and second cavities disposed therein to form the combined cavity 140. In an alternative embodiment, hinge members 810 as described herein may be used.

In an exemplary embodiment, a user may simply and relatively quickly construct a sofa or loveseat. A user removably couples a front furniture member 230 to two opposing side furniture members 220 as described herein. A back furniture member 210 may then be removably coupled to the two opposing side furniture members in a similar manner. It is also contemplated, the back furniture member 210 may be removably coupled to the two opposing side furniture members via a slot as described and shown in FIGS. 2 and 3. Subsequently, a base furniture member may be inserted and/or placed to rest upon the one or more tab members 130 extending out from the interior sides of the furniture members 110. When a user wishes to disassemble, modify, and/or reconfigured the size and/or shape of the furniture, he or she merely needs to remove one or more of the elongated members 120 and furniture members 110.

In addition to providing for quick and easy assembly/disassembly the modular furniture assembly 100 and method enable one or more portion of the furniture assembly to be replaced and/or modified when a user so desires. In a non-limiting example, if one of the plurality of furniture members 110 becomes marked, damaged, old, or otherwise unsuitable for use, a user merely need to replace that particular furniture members. In another non-limiting example, if a user desires a different aesthetic appearance, i.e., color, decorative marking, etc., he or she is merely required to obtain the desired replacement furniture member 110. Advantageously, this may prevent a user of the modular furniture from needing to buy an entirely new piece of furniture.

In one embodiment, the plurality of furniture members 110 may comprise a variety of shapes and/or sizes. The shapes and/or sizes of the furniture members 110 may vary depending on the type of furniture arrangement or configuration. This concept is demonstrated when comparing the side furniture members of FIGS. 2 and 3. FIG. 2 shows two side furniture members 220. One side furniture member 220 comprising an armrest portion, while the other side furniture member 220 is removably coupled to the back furniture member 210. FIG. 3 illustrates and alternative embodiment, wherein the side furniture member 220 comprise a single side furniture member 220, the side furniture member 220 comprising a substantial L-shape, thereby including the armrest portion.

In another exemplary embodiment, the plurality of furniture members 110 may include one or more attachment mechanisms disposed on the surface thereof configured to attach and/or couple upholstery, fabric, leather, or other material to the plurality of furniture members. Such attachment mechanism may comprise any material or mechanisms contemplated in the art, such as but not limited to, hook and loop, adhesive materials, Velcro, and/or so forth.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Additionally, although the figures illustrate the back furniture member 210 removably coupled to the side furniture members 220 via a slot 270, it is contemplated the back furniture member may be removably coupled to the side furniture members via the securing system 150, as described in FIGS. 4 through 7.

It is also envisioned that the plurality of furniture members 110 may include any aesthetic features contemplated in the art such as but limited to, decorative markings, cloth, leather, or fabric types coupled thereto, a variety of colors, and/or so forth.

It is expected that there could be numerous variations of the design of this invention. An example is that the modular furniture assembly may be arranged and/or configured to be sofas, couches, chairs, desks, tables, and/or so forth.

Finally, it is envisioned that the components of the device may be constructed of a variety of materials, such as but not limited to: a variety wood types (i.e., oak, cedar, walnut, etc.), steel, metal, aluminum, cloth, rubber, plastic, polyurethane, and/or so forth.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A modular assembly chair design, comprising:

a) a front vertical member having:

i) a rectangular over all shape, with a width and height longer than the thickness; and ii) a first and second vertical opposite edge both with a tongue and groove cut entirely therealong;

b) a first right vertical side member, orientated in a first planar orientation, having:

i) a rectangular over all shape, with a width and height longer than the thickness; and ii) a first and second vertical opposite edge both with a tongue and groove cut entirely therealong, wherein the first right side member first edge and the front member first edge securely fit into the respective tongue and groove cut of each other forming a front right corner of the modular assembly chair design;

c) a second right vertical side member, orientated in the same planar orientation as the first right side member, having:

i) a rectangular over all shape, with a width and height longer than the thickness;

ii) a first vertical edge with a tongue and groove cut entirely therealong, wherein the second right side member vertical tongue and groove edge and the first right side member second edge securely fit into the respective tongue and groove cut of each other, forming a right side joint;

iii) a second vertical edge opposite the first vertical edge of the second right side member having no tongue and groove cut therein; and iv) a slanted groove extending between a top to a bottom edge of the second right side member, the slanted groove forming an angle with respect to the first and second vertical edge of the second right vertical side member;

d) a first left vertical side member, orientated in a first planar orientation, having:

i) a rectangular over all shape, with a width and height longer than the thickness; and ii) a first and second vertical opposite edge both with a tongue and groove cut entirely therealong, wherein the first left side member first edge and the front member first edge securely fit into the respective tongue and groove cut of each other, forming a front left corner of the modular assembly chair design;

e) a second left vertical side member, orientated in the same planar orientation as the first left side member, having:

i) a rectangular over all shape, with a width and height longer than the thickness;

ii) a first vertical edge with a tongue and groove cut entirely therealong, wherein the second left side member vertical tongue and groove edge and the first left side member second edge securely fit into the respective tongue and groove cut of each other, forming a left side joint of the modular assembly chair design;

iii) a second vertical edge opposite the first vertical edge of the second left side member having no tongue and groove cut therein; and iv) a slanted groove extending between a top to a bottom edge of the second left side member, the slanted groove forming an angle with respect to the first and second vertical edge of the second left vertical side member;

f) a back planar member, slidably engaged into the slanted groove of both the second left and right side member, forming an angle to the front vertical member;

g) a first, second, and third right dowel, which are respectively inserted into cavities vertically extending along the front right corner, right side joint, and the second right side member second vertical edge wherein the first, second, and third right dowels are each of sufficient length to project from the respective front right corner, right side joint, and the second right side member second vertical edge to form right support legs of the modular assembly chair design; and h) a first, second, and third left dowel, which are respectively inserted into cavities vertically extending along the front left corner, left side joint, and the second left side member second vertical edge wherein the first, second, and third left dowels are each of sufficient length to project from the respective front left corner, left side joint, and the second left side member second vertical edge to form left support legs of the modular assembly chair design.

* * * * *